US008020219B2

(12) United States Patent
Jacobsen

(10) Patent No.: US 8,020,219 B2
(45) Date of Patent: Sep. 20, 2011

(54) STRAP ANCHOR SYSTEM AND METHOD

(75) Inventor: Gregg T. Jacobsen, Santa Cruz, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 1775 days.

(21) Appl. No.: 11/173,437

(22) Filed: Jul. 1, 2005

(65) Prior Publication Data

US 2007/0000022 A1 Jan. 4, 2007

(51) Int. Cl.
*A42B 7/00* (2006.01)

(52) U.S. Cl. ..... 2/421

(58) Field of Classification Search ..... 2/410, 411–414, 2/420, 421, 425, 416
See application file for complete search history.

(56) References Cited

U.S. PATENT DOCUMENTS

| | | | | |
|---|---|---|---|---|
| 674,213 | A | 5/1901 | Oldfield | |
| 1,213,800 | A | 1/1917 | Piper | |
| 1,434,745 | A | 11/1922 | MacLeod | |
| 2,270,149 | A | 1/1942 | Gustavo | |
| 2,463,771 | A | 3/1949 | Hunz | |
| 2,905,017 | A | 9/1959 | Randolph | |
| 3,329,968 | A | 7/1967 | Gordon | |
| 3,500,474 | A | 3/1970 | Austin | |
| 4,081,865 | A | 4/1978 | Bergee et al. | 2/425 |
| 4,115,874 | A | 9/1978 | Hasegawa | 2/425 |
| 4,888,831 | A | 12/1989 | Oleson | |
| 5,007,141 | A | 4/1991 | Gentes | 24/163 R |
| 5,088,130 | A | 2/1992 | Chiarella | 2/411 |
| 5,093,937 | A | 3/1992 | Kamata | 2/424 |
| 5,093,938 | A | 3/1992 | Kamata | 2/424 |
| 5,099,523 | A * | 3/1992 | Broersma | 2/411 |
| 5,119,516 | A | 6/1992 | Broersma | 2/411 |
| 5,231,703 | A | 8/1993 | Garneau | 2/414 |
| 5,269,025 | A | 12/1993 | Broersma | 2/411 |
| 5,309,576 | A | 5/1994 | Broersma | 2/412 |
| 5,351,341 | A | 10/1994 | Broersma | 2/412 |
| 5,351,342 | A | 10/1994 | Garneau | 2/414 |
| 5,357,654 | A | 10/1994 | Hsing-Chi | |
| 5,469,583 | A | 11/1995 | Akeley et al. | 2/421 |
| 5,477,563 | A | 12/1995 | Gentes et al. | 2/411 |

(Continued)

FOREIGN PATENT DOCUMENTS

EP 0 517 091 12/1992

(Continued)

OTHER PUBLICATIONS

U.S. Appl. No. 12/202,960, entitled Height-Adjustable Fit System, filed Sep. 2, 2008, pending.

(Continued)

*Primary Examiner* — Tejash Patel
(74) *Attorney, Agent, or Firm* — Baker Botts L.L.P.

(57) ABSTRACT

In accordance with the teachings of the present invention, a strap anchor system and method are provided. In a particular embodiment of the present invention, the system includes a helmet body, a support structure substantially disposed within the helmet body, and a strap anchor housing coupled to the support structure and substantially disposed within the helmet body. The strap anchor housing is operable to receive a strap anchor after formation of the helmet body. The strap anchor is operable to couple a strap to the strap anchor housing so that a load on the strap is transferred to the support structure before being transferred to the helmet body.

21 Claims, 6 Drawing Sheets

U.S. PATENT DOCUMENTS

| | | | | |
|---|---|---|---|---|
| 5,481,762 | A | 1/1996 | Gentes et al. | 2/411 |
| 5,551,094 | A | 9/1996 | Navone | |
| 5,608,917 | A | 3/1997 | Landis | |
| 5,619,756 | A | 4/1997 | Garneau | 2/425 |
| 5,651,145 | A | 7/1997 | Egger | |
| 5,659,900 | A | 8/1997 | Arney et al. | 2/417 |
| 5,675,843 | A | 10/1997 | Grim et al. | 2/422 |
| 5,729,877 | A | 3/1998 | Kong et al. | 24/625 |
| 5,745,924 | A | 5/1998 | Egger | |
| 5,774,901 | A | 7/1998 | Minami | 2/421 |
| 5,794,272 | A | 8/1998 | Workman et al. | |
| 5,833,796 | A | 11/1998 | Matich | 156/285 |
| 5,867,840 | A | 2/1999 | Hirosawa et al. | 2/414 |
| 5,887,288 | A | 3/1999 | Arney et al. | 2/421 |
| 5,896,586 | A | 4/1999 | Freund | |
| 5,898,949 | A * | 5/1999 | Barthold et al. | 2/416 |
| 5,983,405 | A | 11/1999 | Casale | |
| 6,009,561 | A | 1/2000 | Bullock et al. | 2/422 |
| 6,009,562 | A | 1/2000 | Bullock et al. | 2/422 |
| 6,105,176 | A | 8/2000 | Egger | |
| 6,226,802 | B1 | 5/2001 | Sasaki et al. | |
| 6,292,952 | B1 * | 9/2001 | Watters et al. | 2/411 |
| 6,314,588 | B1 | 11/2001 | Fang | |
| 6,332,227 | B1 | 12/2001 | Fang | |
| 6,401,261 | B1 | 6/2002 | Arney et al. | 2/421 |
| 6,421,840 | B1 | 7/2002 | Chen et al. | 2/410 |
| 6,446,270 | B1 | 9/2002 | Durr | 2/412 |
| 6,449,776 | B1 | 9/2002 | Musal | 2/418 |
| 6,457,210 | B1 | 10/2002 | Shirai | |
| 6,481,019 | B2 | 11/2002 | Diaz | |
| 6,694,529 | B1 | 2/2004 | Chiu | 2/411 |
| 6,711,751 | B1 | 3/2004 | Muskovitz | 2/410 |
| 7,069,601 | B1 | 7/2006 | Jacobsen | |
| 7,111,329 | B2 | 9/2006 | Stroud et al. | |
| 7,203,972 | B2 | 4/2007 | Piertzak et al. | |
| 7,222,374 | B2 | 5/2007 | Musal et al. | |
| 2002/0124298 | A1 | 9/2002 | Muskovitz | 2/410 |
| 2005/0262619 | A1 | 12/2005 | Musal et al. | |
| 2006/0248630 | A1 | 11/2006 | Bullock et al. | |
| 2007/0000022 | A1 | 1/2007 | Jacobsen | |
| 2007/0044210 | A1 | 3/2007 | Muller | |
| 2007/0277295 | A1 | 12/2007 | Bullock | |

FOREIGN PATENT DOCUMENTS

| | | |
|---|---|---|
| JP | 10-130939 | 8/1998 |
| WO | WO 91/13560 | 9/1991 |
| WO | WO 2004/006706 | 1/2004 |

OTHER PUBLICATIONS

Notification of Transmittal of International Search Report, mailed Oct. 17, 2005, regarding International Application No. PCT/US2005/253718.0-2314, 3 pages.

* cited by examiner

FIG. 2B
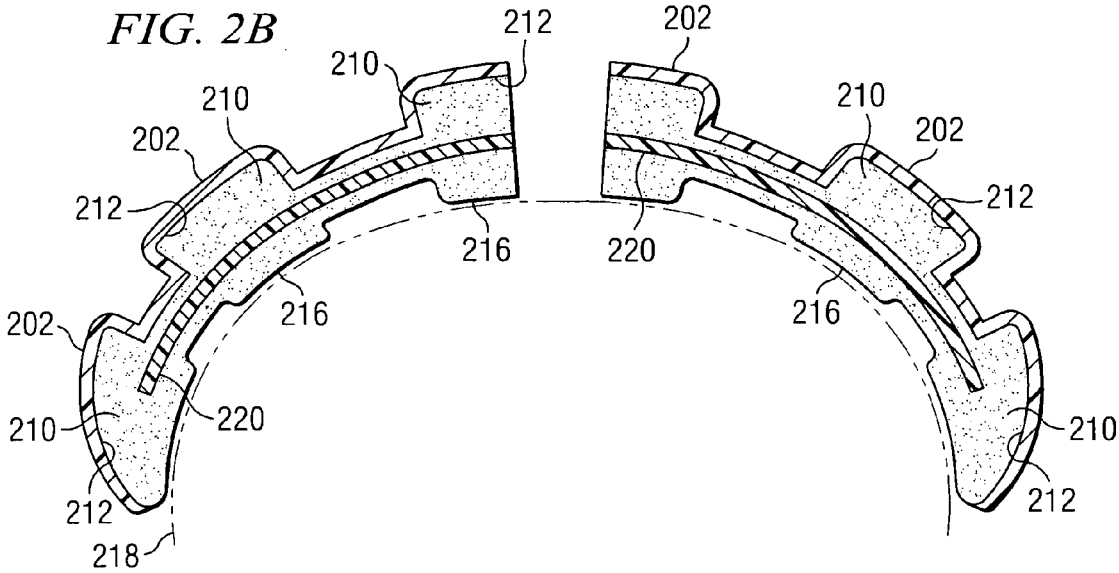
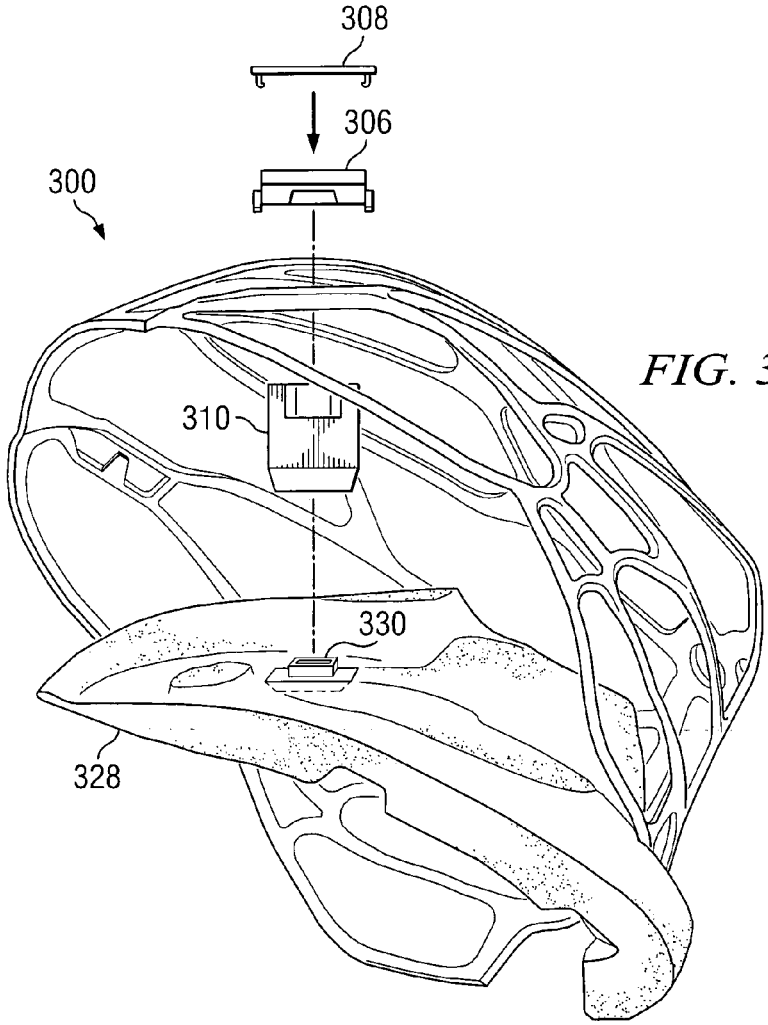
FIG. 3A

STRAP ANCHOR SYSTEM AND METHOD

TECHNICAL FIELD OF THE INVENTION

The present invention relates generally to protective headgear and more particularly to a strap anchor system and method.

BACKGROUND OF THE INVENTION

A physical impact to the head of a person may cause serious injury or death. To reduce the probability of these injuries, protective headgear, such as a helmet, is often used in activities associated with an increased risk of such injuries. Examples of such activities include skiing, snowboarding, bicycling, rollerblading, rock climbing, skateboarding, and motorcycling, among others. In general, a helmet is designed to maintain its structural integrity and stay secured to the head of a wearer during an impact. Typically, a helmet retention system comprised of one or more straps is used to secure the helmet to the head of the wearer.

SUMMARY OF THE INVENTION

In accordance with the teachings of the present invention, a strap anchor system and method are provided. In a particular embodiment of the present invention, the system comprises a helmet body, a support structure substantially disposed within the helmet body, and a strap anchor housing coupled to the support structure and substantially disposed within the helmet body. The strap anchor housing is operable to receive a strap anchor after formation of the helmet body. The strap anchor is operable to couple a strap to the strap anchor housing so that a load on the strap is transferred to the support structure before being transferred to the helmet body.

A technical advantage of particular embodiments of the present invention may include the ability to couple a helmet retention system to a support structure, such as a roll cage, after the support structure has been in-molded in a helmet body. This helps reduce the cost and complexity of manufacturing the helmet.

Another technical advantage of particular embodiments of the present invention may include the ability to couple a helmet retention system with a helmet without the use of external strap bones that clutter the external appearance of the helmet and impede the application of graphics to the outer surface of the helmet.

Other technical advantages of the present invention may be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present invention and features and advantages thereof, reference is now made to the following description, taken in conjunction with the accompanying drawings, in which:

FIG. 2B illustrates a cross-section view of the helmet shown in FIG. 2A;

FIG. 3A illustrates a perspective view of a roll cage in accordance with a particular embodiment of the present invention;

DETAILED DESCRIPTION OF THE INVENTION

In accordance with the teachings of the present invention, a strap anchor system and method are provided. In particular embodiments, the strap anchor system comprises a helmet body, a support structure substantially disposed within the helmet body, and a strap anchor housing coupled to the support structure. The strap anchor housing is operable to couple a strap to the support structure so that a load on the strap is transferred to the support structure before being transferred to the helmet body. Such a strap anchor system allows for the coupling of a helmet retention system to an in-molded support structure, such as a roll cage, after formation of the helmet body. In particular embodiments, this post-molding coupling of the helmet retention system may reduce the cost and complexity of manufacturing the helmet. Moreover, strap anchors in accordance with particular embodiments of the present invention need not rely on external strap bones. This allows for a more aesthetically pleasing external appearance and facilitates the application of graphics to the outer surface of the helmet body.

Figure 1:
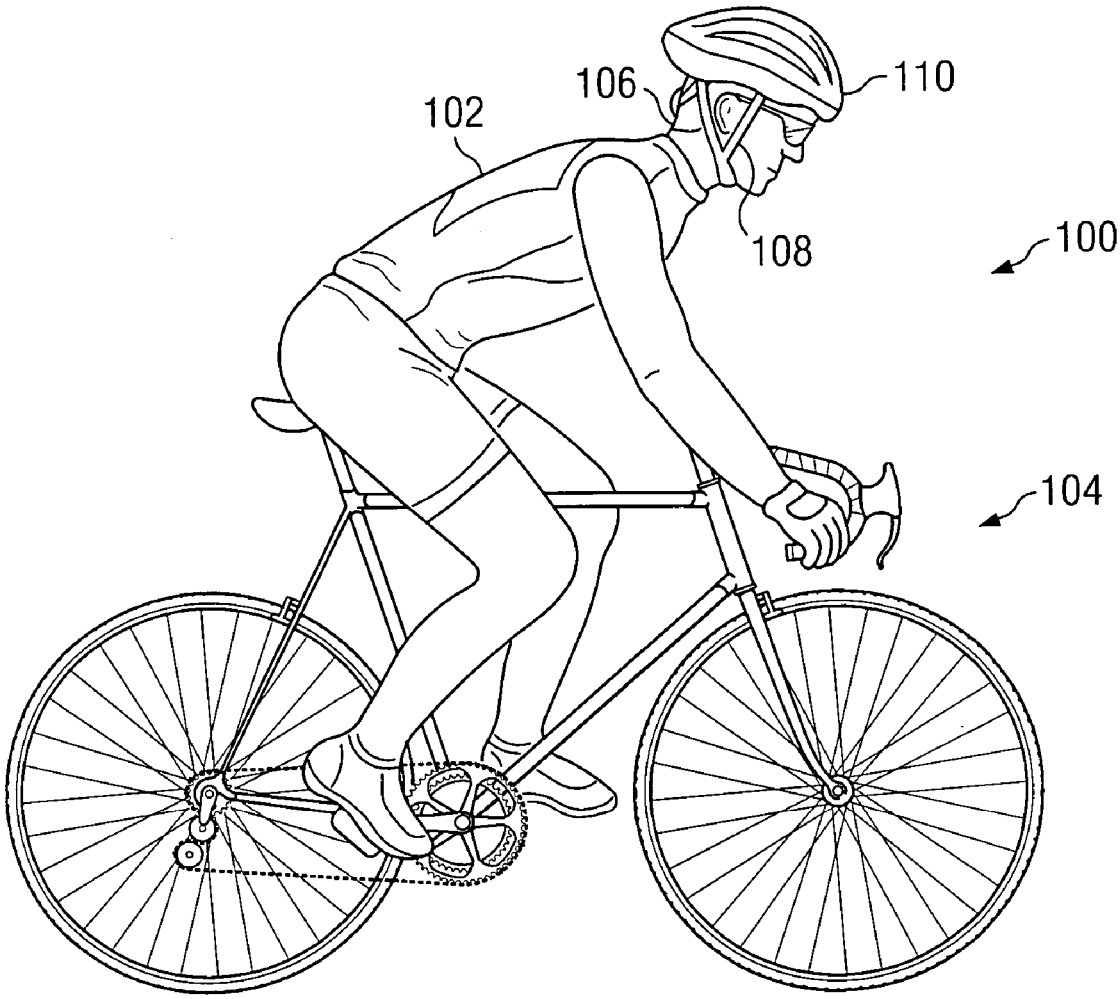
FIG. 1 illustrates one environment in which a helmet in accordance with a particular embodiment of the present invention may be used.

FIG. 1 illustrates one embodiment of an environment 100 in which a helmet 110 in accordance with a particular embodiment of the present invention may be used. As shown in FIG. 1, environment 100 includes a bicyclist (user) 102 riding a bicycle 104 and wearing helmet 110. Helmet 110 may be secured to head 106 of user 102 using one or more straps 108, which along with any other devices having a primary function of securing helmet 110 to head 106, may be referred to as a "helmet retention system." As used herein, the term "helmet" refers to any type of protective headgear, such as a bicycle helmet, a motorcycle helmet, or a hardhat. Furthermore, although helmet 110 is used as an example to describe some embodiments of the present invention, any type of helmet, both protective and non-protective, may benefit from the teachings of the present invention.

If user 102 were to accidentally fall off bicycle 104, user 102 could suffer various injuries, including head trauma. Therefore, helmet 110 is designed to remain secured to head 106 during an impact and maintain its structural integrity to better protect head 106. As a secondary consideration, helmet 110 may also be designed to have an attractive appearance. For example, many users find a helmet with a sleek external appearance to be attractive. Such a sleek external appearance also facilitates the application of graphics to the external surface of the helmet.

Figure 2A:
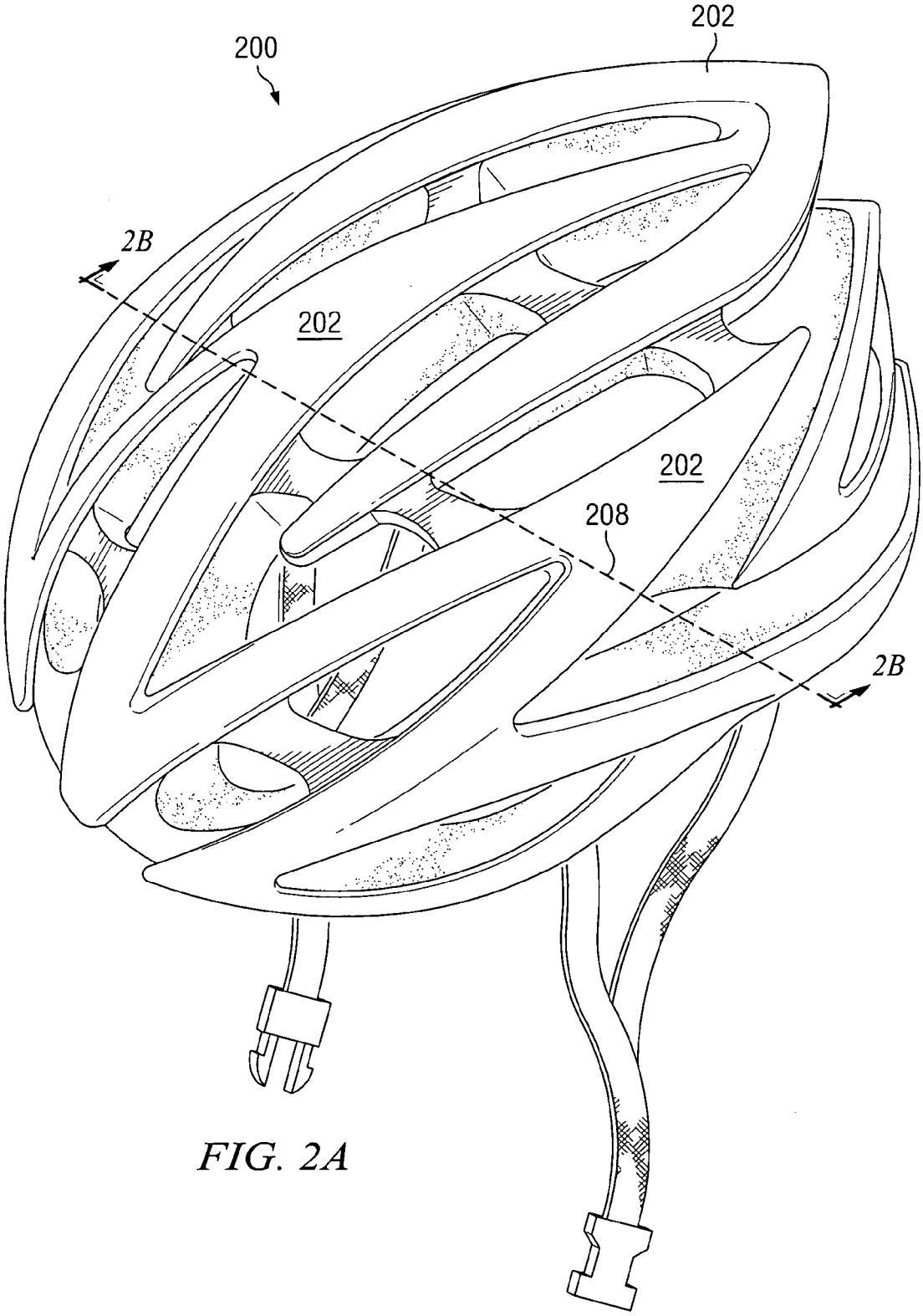
FIG. 2A illustrates a perspective view of a helmet in accordance with a particular embodiment of the present invention.

Another example of a helmet is shown in FIGS. 2A-B, which illustrate two different views of a helmet 200 in accordance with a particular embodiment the present invention. FIG. 2A illustrates a perspective view of helmet 200, while FIG. 2B illustrates a cross-section of helmet 200 at a phantom line 208 shown in FIG. 2A. Similar to helmet 110 in FIG. 1, helmet 200 is designed to remain secured to the head of a user during an impact and maintain its structural integrity to better protect the user's head.

As shown in FIGS. 2A and 2B, helmet 200 generally comprises a helmet body 210 having an outer surface 212 and an inner surface 216. Helmet 200 also comprises a protective layer or shell 202 disposed on the outer surface 212 of body 210 and a support structure 220 disposed substantially within body 210.

Generally, helmet body 210 may be formed from any suitable material that can protect the head 106 (FIG. 1) of user 102 (FIG. 1), such as expandable polystyrene (EPS), while protective layer 202 may be formed from any suitable material that can protect helmet body 210, such as polycarbonate plastic. Protective layer 202 may also be used to add color, pictures, patterns, and/or any other design elements to helmet 200.

As mentioned above, helmet 200 also includes a support structure 220 disposed substantially within body 210. Generally, support structure 220 provides one or more attachment points for a helmet retention system that may be used to secure helmet 200 to the head of a user. In particular embodiments, support structure 220 may also help improve the structural integrity of helmet 200. Examples of suitable support structures 200 may include a roll cage, a butterfly, or any other structure than may be in-molded in a helmet body to provide an attachment point for a strap anchor system in accordance with the teachings of the present invention. An example of one such support structure 220 is illustrated in FIGS. 3A and 3B.

Figure 3B:
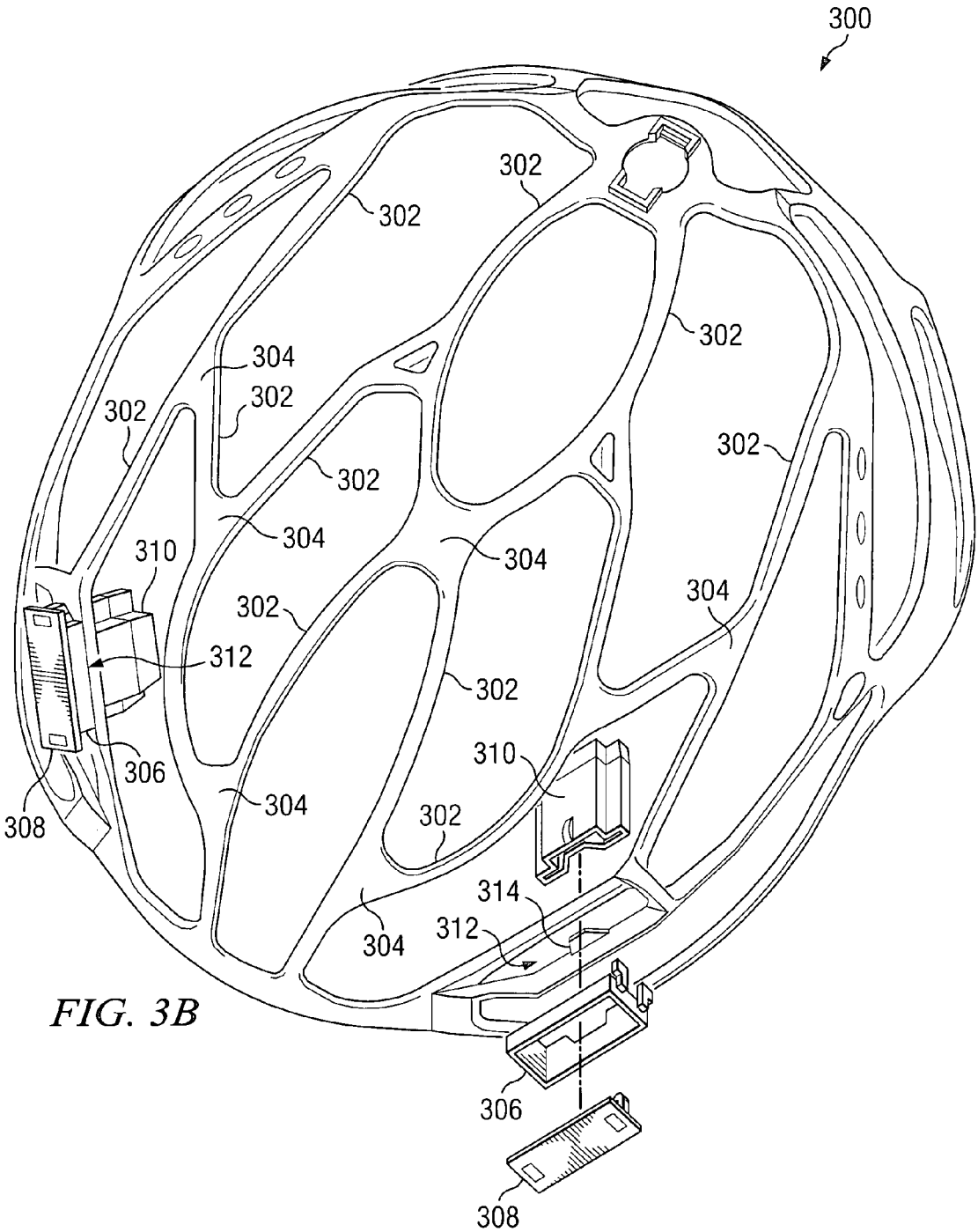
FIG. 3B illustrates another perspective view of the roll cage shown in FIG. 3A.

FIGS. 3A and 3B illustrate a roll cage 300 that utilizes an strap anchor system in accordance with a particular embodiment of the present invention. As shown in FIGS. 3A and 3B, roll cage 300 generally comprises a plurality of members 302 that are coupled with each other through a plurality of junctions 304. These members 302 may be formed from a plastic material (such as ZYTEL ST 801™) or another suitably tough material. In particular embodiments of the present invention, roll cage 300 may also include slots and/or attachment points to couple a helmet retention system to roll cage 300.

Roll cage 300 is configured to receive one or more strap anchor housings 306, which are each operable to couple a strap anchor 316 (FIG. 3D) to roll cage 300. As shown in FIGS. 3A and 3B, strap anchor housings 306 are typically distinct components, separate from roll cage 300. However, in particular embodiments of the present invention, strap anchor housings 306 may be formed integrally with roll cage 300. Similarly, a helmet retention system is typically coupled to roll cage 300 after roll cage 300 has been in-molded in a helmet body, such as helmet body 210 in FIG. 2B. However, particular embodiments of the present invention may couple straps anchors 316 (FIG. 3D) to roll cage 300 prior to molding. These embodiments, however, may not benefit from the reduced manufacturing complexity seen in other embodiments that employ post-molding insertion of the strap anchors 316.

Generally, each strap anchor housing 306 is configured to received a strap anchor housing cover 308 and a strap anchor housing insert 310. Housing cover 308 and housing insert 310 each help prevent EPS or other material from entering housing 306 during molding and clogging the interior of the housing. In particular embodiments of the present invention, housing cover 308 may be formed separately from strap anchor housing 306. This facilitates the formation and machining of the internal components of the housing 306. However, in other embodiments of the present invention, housing cover 308 may be formed integrally with strap anchor housing 306 within the teachings of the present invention.

As mentioned above, strap anchor housing 306 is also configured to receive strap anchor housing insert 310. Like housing cover 308, insert 310 also helps prevent EPS or other material from entering strap anchor housing 306 during molding. Strap anchor housing insert 310 also helps form a channel in the helmet body (not illustrated) during formation the helmet body around roll cage 300 though which strap 326 (FIG. 3D) and strap anchor 316 (FIG. 3D) may be coupled with housing 306. Housing insert 310 is configured to be removeably coupled with housing 306. After roll cage 300 and housing 306 have been molded into a helmet body, insert 310 may be removed from housing 306, leaving in its place the channel between housing 306 and an inner surface of the helmet body. Through this channel, strap anchor 316 (FIG. 3D) may be coupled with strap anchor housing 306.

In particular embodiments of the present invention, strap housing insert 310 may also be used to help position roll cage 300 in a mold prior to formation of the helmet body. In such an embodiment, insert 300 may be removeably coupled with a connector 330 on the male (convex) portion 328 of the mold to properly position roll cage 300 in the mold. After formation of the helmet body, insert 310 may be decoupled and removed from the mold.

Figure 3C:
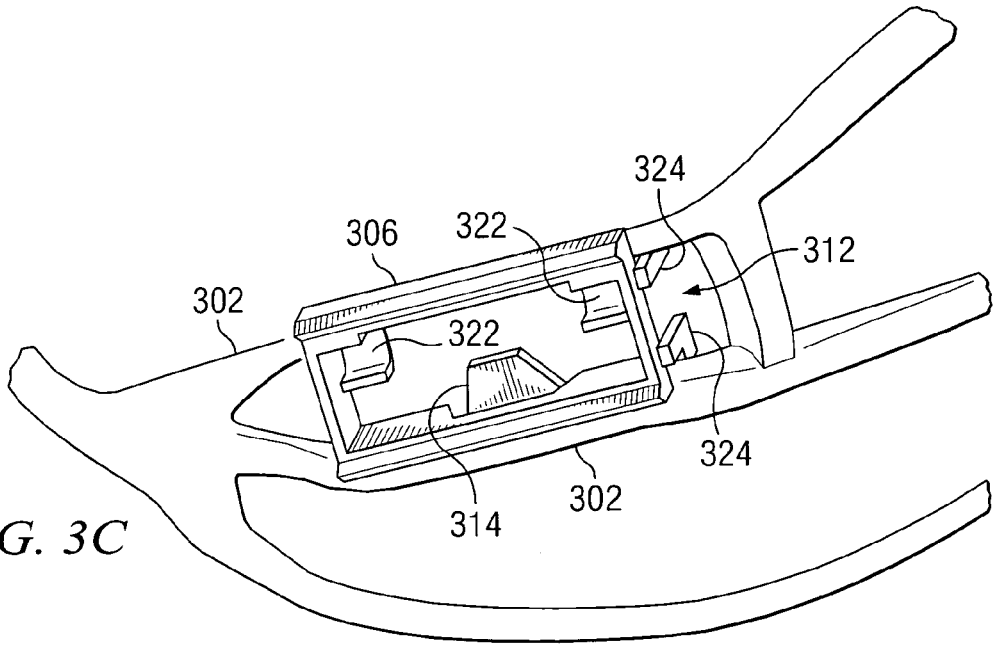
FIG. 3C illustrates a close-up view of an in-molded strap anchor coupled with the roll cage shown in FIG. 3A.
Figure 3D:
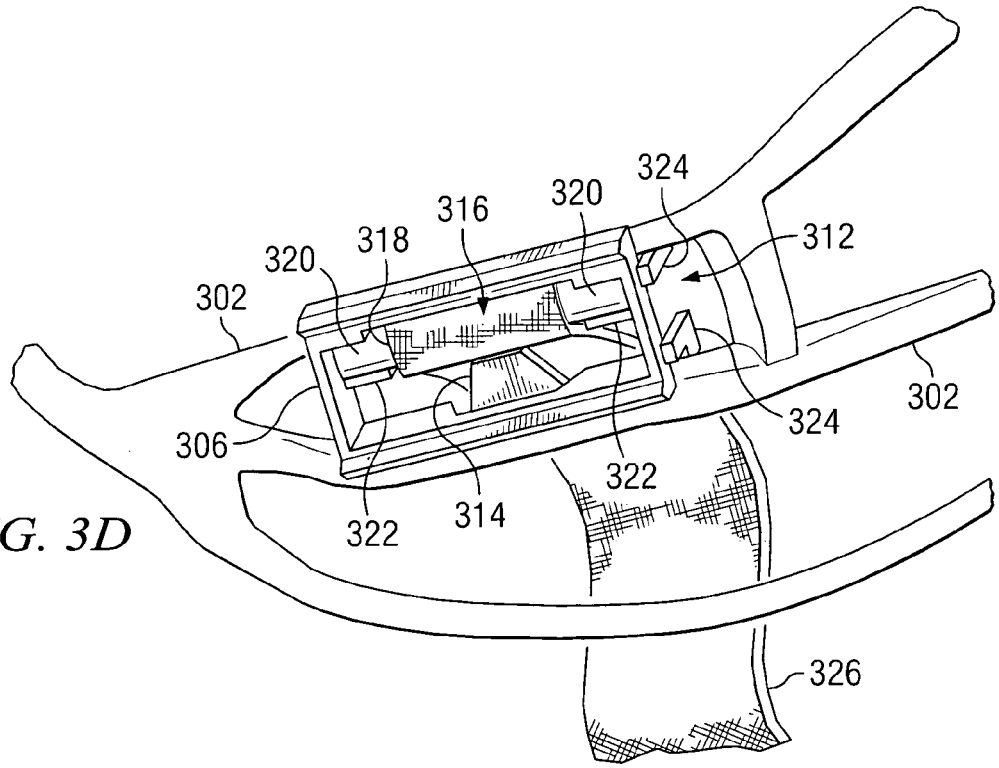
FIG. 3D illustrates a close-up view of a strap secured in the in-molded strap anchor shown in FIG. 3C.

Particular embodiments of the present invention may use a variety of mechanisms to couple a helmet retention system to strap anchor housing 306 and/or to couple strap anchor housing 306 to roll cage 300. One such mechanism is illustrated in FIGS. 3C and 3D. Although FIGS. 3C and 3D do not illustrate a helmet body encompassing roll cage 300, it should be understood that strap 326 and strap anchors 316 are typically coupled to roll cage 300 after roll cage 300 has been molded into a helmet body.

Generally, strap anchor housing 306 is configured to be coupled with roll cage 300, sitting in an opening 312 between two approximately parallel members 302. In particular embodiments of the present invention, these approximately parallel members 302 may be angled toward each other such that members 302 approach each other as they approach the inner surface of the helmet body. So arranged, housing 306 may sit in, but not be pulled through, opening 312. This helps ensure housing 306 will not become decoupled from roll cage 300 under stress. In particular embodiments, housing 306 may be further coupled to roll cage 300 using a plurality of clips 324 to lock housing 306 into place. However, any suitable method may be used to couple housing 306 to roll cage 300, in accordance with the teachings of the present invention.

Generally, strap anchor housing 306 is configured to receive a strap anchor 316 on the end of a strap 326. Although embodiments of the present invention may differ, in particular embodiments, strap anchor 316 comprises a pin 320 secured in a loop 318. Loop 318 may be formed by folding strap 326 back over on itself and stitching, or "bar-tacking," the strap 326 in place. Held in place by loop 318, pin 320 may then be inserted into and coupled with housing 306.

In particular embodiments of the present invention, the coupling of strap anchor 316 and housing 306 may be accomplished by securing pin 320 in a pin cradle 322 in the strap anchor housing 306. In particular embodiments, securing pin 320 in pin cradle 322 may be facilitated by flexible tab 314, which extends from roll cage 300 into housing 306. In these embodiments, strap anchor 316 may be inserted in housing 306 such that flexible tab 314 is pushed to the side of housing 316 during insertion. With tab 314 pushed to the side, pin 320 may be freely inserted into housing 306. Tab 314 may then spring back into its original position, as shown in FIG. 3D, helping to position and/or secure pin 320 in pin cradle 322.

A variety of other mechanisms of securing strap anchor 316 in housing 306 may be used in accordance with the teachings of the present invention. For example, in particular embodiments housing 306 may employ a ratcheting mechanism to secure pin 320 so that pin 320 may not be removed once inserted. As pin 320 is inserted to housing 306, pin 320 may encounter a series of teeth (not illustrated) that engage pin 320 to prevent its removal. These teeth allow pin 320 to be inserted into, but not removed from, housing 306. In other embodiments, pin 320 may comprise an expandable pin that extends once inserted into housing 306. In particular embodiments, this expandable pin 320 may comprise a spring-loaded pin. Once extended, the ends of pin 320 may then fit into a pin cradle 322 or a slot (not illustrated) to secure pin 320 in housing 306. With the benefit of this disclosure, other suitable mechanisms for securing pin 320 in housing 306 should be apparent to one skilled in the art, all of which fall within the teachings of the present invention.

Given that strap anchor housing 306 may be substantially encompassed by a helmet body, particular embodiments of the present invention may employ insertion tools (not illustrated) to facilitate the coupling of strap anchor 316 with strap anchor housing 306. For example, a flat blade may be used to force strap anchor 316 through the channel in the helmet body (not illustrated) left by housing insert 310 and into position in housing 306. After strap anchor 316 is in place in housing 306, the blade may be removed from the channel, leaving strap 326 securely coupled to roll cage 300 by strap anchor 316 and strap anchor housing 306.

Although FIG. 3D describes a strap anchor 316 that generally comprises a pin 320 secured in a fabric loop 318, other embodiments of the present invention may employ a variety of different strap anchors. For example, particular embodiments of the present invention may employ a strap anchor comprising a relatively rigid piece of plastic or other suitable material that is coupled to housing 306 after formation of the helmet body and extends beyond the inner surface of the helmet body. In such an embodiment, strap 326 may be coupled with the strap anchor outside of the helmet body. The use of such a relatively rigid strap anchor may facilitate the coupling of strap anchor to housing 306 and even obviate the need for additional insertion tools. Such a strap anchor may also allow for straps 326 to be coupled and decoupled from the strap anchor without requiring strap anchor to be first decoupled from roll cage 300. Other benefits of various strap anchor designs will be apparent to one skilled in the art with the benefit of this disclosure.

Figure 4:
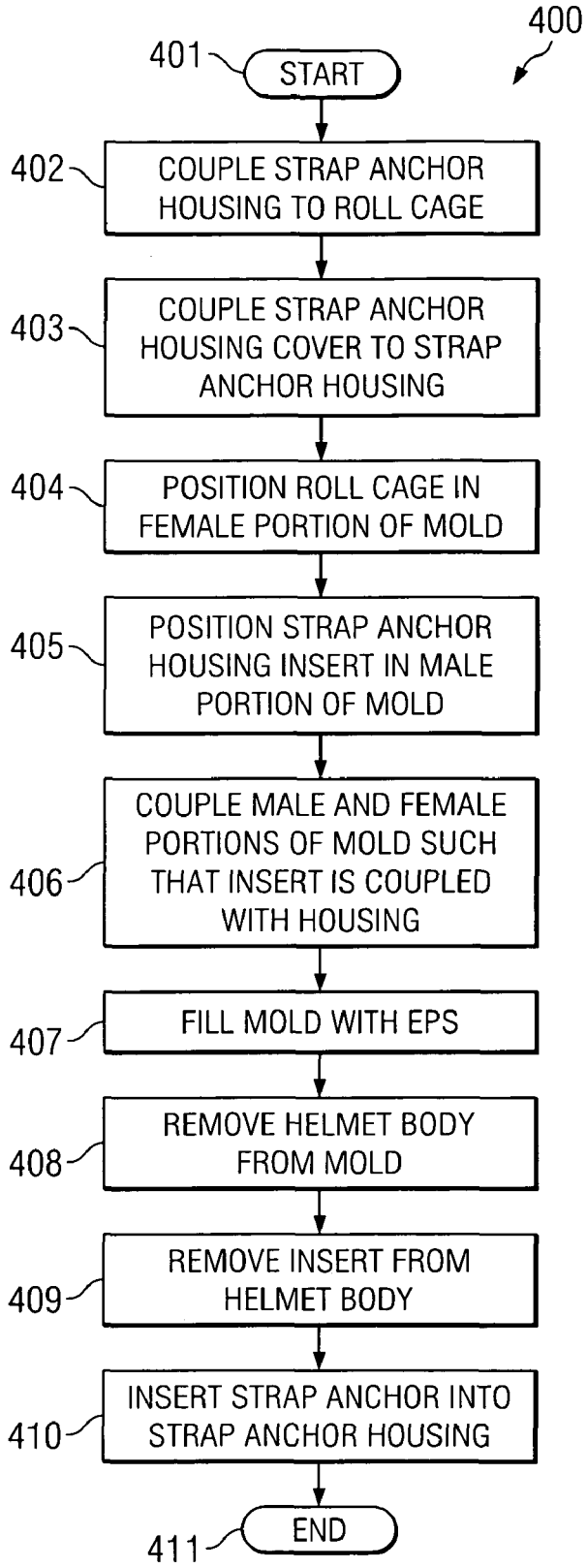
FIG. 4 illustrates a flowchart of a method of coupling a helmet retention system with a roll cage of a helmet in accordance with a particular embodiment of the present invention.

A better understanding of the strap anchor system and method of the present invention may be had by making reference to FIG. 4, which illustrates a flowchart 400 of a method for coupling a helmet retention system to a helmet using an strap anchor system in accordance with a particular embodiment of the present invention.

Flowchart 400 begins in block 401. One or more strap anchors housings are then coupled to a roll cage in block 402. In particular embodiments this is done by clipping each of the housings into place in an opening in the roll cage designed to receive them. Once the strap anchor housings are coupled to the roll cage, each housing is then coupled with a respective housing cover in block 403 to prevent EPS or other materials from entering the housing during molding. The roll cage and covered strap anchor housings are then positioned in the female (concave) portion of a helmet mold in block 404.

At block 405, a strap anchor housing insert for each strap anchor housing is positioned in the male (convex) portion of the helmet mold. In particular embodiments of the present invention, this may be accomplished by removeably coupling the insert with a connector on the male portion of the mold. The male and female portions of the helmet mold are then closed together in block 406 such that each insert is coupled with its respective strap anchor housing. In this manner, the inserts may also be used to properly position the roll cage within the helmet mold. The strap anchor housing inserts also define a channel between each strap anchor housing and the inner surface of the helmet being molded. The helmet mold is then filled with EPS, or another suitable material, and is heated to form a helmet body around the roll cage and strap anchor housings at block 407. The molded helmet is then removed from the mold at block 408.

Once the molded helmet is removed from the mold, the strap anchor housing inserts are removed from the molded body at block 409, leaving behind a channel from each strap anchor housing to the inner surface of the helmet body. Through this channel, a helmet retention system comprising one or more straps may be coupled with the roll cage in block 410. Using a flat blade, or other suitable insertion tool, a strap anchor on the end of each strap may be inserted into and coupled with its respective strap anchor housing in-molded in the helmet body. After insertion of the strap anchors, the flowchart terminates at block 411.

Although flowchart 400 describes a particular order of step for coupling a helmet retention system with a helmet in accordance with a particular embodiment of the present invention, particular embodiments of the present invention may use all, some, or none of the steps described above. Moreover, particular embodiments may perform those steps in a different order than that described above without departing from the teachings of the present invention. Similarly, the method described in flowchart 400 is not limited to roll cages, but may be employed with other support structures in accordance with the teachings of the present invention.

Strap anchor systems in accordance with particular embodiments of the present invention may offer numerous advantages over other strap anchor systems. For example, by allowing for post-molding coupling of the straps of the helmet retention system with a support structure, such as a roll cage, particular embodiments of the present invention reduce the cost and complexity of manufacturing helmets. Particular embodiments of the present invention may also offer the ability to couple the straps of the helmet retention system to the helmet without the use of external strap bones or other devices that may reduce the aesthetic appeal of the helmet or impede the application of graphics to the outer surface of the helmet body.

Although particular embodiments of the method and apparatus of the present invention have been illustrated in the accompanying drawings and described in the foregoing detailed description, it will be understood that the invention is not limited to the embodiments disclosed, but is capable of numerous rearrangements, modifications, and substitutions without departing from the spirit of the invention as set forth and defined by the following claims.

What is claimed is:

1. A helmet comprising:

a helmet body;

a roll cage substantially disposed within the helmet body; and a strap anchor housing coupled to the roll cage and substantially embedded within the helmet body, the strap anchor housing operable to receive a strap anchor, the strap anchor operable to couple a strap to the strap anchor housing so that a load on the strap is transferred to the roll cage before being transferred to the helmet body.

2. The system of claim 1, wherein the strap anchor housing is directly coupled to the roll cage.

3. The system of claim 1, wherein the strap anchor housing is formed integrally with the roll cage.

4. The system of claim 1, further comprising a strap anchor housing insert operable to be coupled with the strap anchor and define a channel between the strap anchor and an inner surface of the helmet body.

5. The system of claim 1, further comprising a strap anchor housing cover coupled with the strap anchor housing, the strap anchor housing cover configured to prevent the flow of material into the strap anchor housing.

6. The system of claim 5, wherein the strap anchor housing cover is formed integrally with the strap anchor housing.

7. The system of claim 1, further comprising a tab extending from the roll cage into the strap anchor housing, the tab operable to position the strap anchor in the strap anchor housing.

8. The system of claim 1, wherein the strap anchor comprises a pin positioned in a loop formed in the strap.

9. The system of claim 8, wherein the strap anchor housing comprises a pin cradle operable to receive the pin of the strap anchor.

10. A method for coupling a retention system with a helmet, comprising:

coupling at least one strap anchor housing with a roll cage;

forming a helmet body that substantially encompasses the roll cage and the strap anchor housing;

defining a channel between the strap anchor housing and an inner surface of the helmet body during formation of the helmet body;

inserting a strap anchor into the strap anchor housing through the channel between the strap anchor housing and the inner surface of the helmet body; and coupling the strap anchor to the strap anchor housing such that a load on the strap is transferred to the roll cage before being transferred to the helmet body.

11. The method of claim 10, wherein defining a channel between the strap anchor housing and an inner surface of the helmet body comprises:

coupling a strap anchor housing insert with the strap anchor housing prior to formation the helmet body; and decoupling the strap anchor housing insert from the strap anchor housing after formation of the helmet body such that a channel between the strap anchor housing and the inner surface of the helmet body is formed by the removal of the strap anchor housing insert.

12. The method of claim 10, wherein coupling the strap anchor housing with the roll cage comprises forming the strap anchor housing as an integral part of the roll cage.

13. The method of claim 10, wherein coupling the strap anchor housing with the roll cage comprises directly coupling the strap anchor housing with the roll cage.

14. The method of claim 10, further comprising forming a strap anchor on an end of a strap by folding the strap to form a loop, securing the loop with stitching, and positioning a pin through the loop.

15. The method of claim 14, wherein coupling the strap anchor with the strap anchor housing comprises inserting the pin of the strap anchor into a pin cradle in the strap anchor housing.

16. A method for molding a strap anchor housing in a helmet, comprising:

coupling at least one strap anchor housing with a support structure;

coupling a strap anchor housing insert with the strap anchor housing;

forming a helmet body that substantially encompasses the support structure, the strap anchor housing, and the strap anchor housing insert such that the strap anchor housing insert defines a channel between the strap anchor housing and an inner surface of the helmet body;

decoupling the strap anchor housing insert from strap anchor housing after formation of the helmet body; and removing the strap anchor housing insert from the channel between the strap anchor housing and the inner surface of the helmet body.

17. The method of claim 16, wherein the support structure comprises a roll cage.

18. The method of claim 16, further comprising coupling a strap anchor housing cover with the strap anchor housing prior to formation of the helmet body.

19. The method of claim 16, further comprising:

inserting a strap anchor into the channel between the strap anchor housing and the inner surface of the helmet body; and coupling the strap anchor with the strap anchor housing so that a load on the strap is transferred to the support structure before being transferred to the helmet body.

20. The method of claim 19, further comprising forming the strap anchor on an end of a strap by folding the strap to form a loop, securing the loop with stitching, and positioning a pin through the loop.

21. The method of claim 20, wherein coupling the strap anchor with the strap anchor housing comprises inserting the pin of the strap anchor into a pin cradle in the strap anchor housing.

* * * * *